US007165697B1

(12) United States Patent
Checkalski

(10) Patent No.: US 7,165,697 B1
(45) Date of Patent: Jan. 23, 2007

(54) CONCENTRIC TWO-COMPARTMENT DRINKING VESSEL

(76) Inventor: Joel Checkalski, 3725 Cranberry Lake Rd., Weyerhaeuser, WI (US) 54895

( * ) Notice: Subject to any disclaimer, the term of this patent is extended or adjusted under 35 U.S.C. 154(b) by 428 days.

(21) Appl. No.: 10/719,339

(22) Filed: Nov. 24, 2003

(51) Int. Cl.
*B65D 25/04* (2006.01)
*B65D 1/24* (2006.01)
*B65D 1/04* (2006.01)

(52) U.S. Cl. ..... 220/505; 220/506; 215/6

(58) Field of Classification Search ..... 220/505, 220/506, 553, 555; 215/6
See application file for complete search history.

(56) References Cited

U.S. PATENT DOCUMENTS

| | | | | | |
|---|---|---|---|---|---|
| 149,887 | A | | 4/1874 | Sawyer | |
| 256,777 | A | | 5/1882 | Leonard | |
| 1,164,050 | A | | 12/1915 | Zodac | |
| 1,275,467 | A | | 8/1918 | Poulalion | |
| 1,488,397 | A | | 3/1924 | Judge et al. | |
| 1,848,331 | A | | 3/1932 | Esslinger | |
| 1,941,327 | A | | 12/1933 | Turner | |
| 2,026,449 | A | * | 12/1935 | Ward | 215/6 |
| 2,162,629 | A | * | 6/1939 | McBride | 40/324 |
| 2,327,077 | A | * | 8/1943 | Tector | 220/23.86 |
| 2,327,078 | A | * | 8/1943 | Teetor | 220/23.83 |
| 2,428,056 | A | | 9/1947 | Wachsman | |
| 2,656,837 | A | * | 10/1953 | Bryan | 604/78 |
| 3,261,494 | A | | 7/1966 | Walker, Jr. | |
| 3,729,114 | A | * | 4/1973 | Mari | 220/504 |
| 4,150,089 | A | | 4/1979 | Linet | |
| 4,277,000 | A | * | 7/1981 | Jaarsma | 222/142.4 |
| 4,410,085 | A | | 10/1983 | Beneziat et al. | |
| 4,428,490 | A | | 1/1984 | Holloway | |
| 4,955,503 | A | | 9/1990 | Propes | |
| 5,223,245 | A | | 6/1993 | Ibrahim et al. | |
| 5,398,827 | A | | 3/1995 | Armstrong et al. | |
| 5,405,030 | A | | 4/1995 | Frazier | |
| D373,707 | S | | 9/1996 | Seaburg | |
| 5,553,725 | A | | 9/1996 | Clemons | |
| 5,857,584 | A | | 1/1999 | Taggart | |
| 5,878,908 | A | | 3/1999 | Foley | |
| D409,442 | S | | 5/1999 | Kilpatrick et al. | |
| 5,934,501 | A | | 8/1999 | Wright et al. | |
| 5,954,213 | A | | 9/1999 | Gerhart et al. | |
| D421,367 | S | | 3/2000 | Naft et al. | |
| 2003/0052018 | A1 | | 3/2003 | Wilson | |

* cited by examiner

*Primary Examiner*—Jes F. Pascua
*Assistant Examiner*—Shawn M Braden
(74) *Attorney, Agent, or Firm*—Tipton L. Randall

(57) ABSTRACT

A two-compartment drinking vessel includes an outer drinking vessel having a closed bottom section, a generally vertical sidewall section with an upper rim there around and an open top. Within the outer vessel is an inner, closed bottom, linear vessel with a sidewall section having an upper rim there around and an open top. The interior vessel sidewall section extends essentially diagonally from at or near the outer vessel upper rim to a selected point adjacent the sidewall and bottom sections of the outer vessel. Liquids poured into the outer vessel and inner vessel are separately contained until the two-compartment vessel is tilted to drink. The liquid contained by the inner vessel flows from the two-compartment vessel prior to the liquid contained in the outer vessel flowing therefrom.

19 Claims, 6 Drawing Sheets

CONCENTRIC TWO-COMPARTMENT DRINKING VESSEL

CROSS-REFERENCE TO RELATED APPLICATIONS, IF ANY

Not applicable

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates to a drinking vessel, and more particularly, to a two-compartment drinking vessel. Most particularly, the invention relates to a concentric two-compartment drinking vessel.

2. Background Information

The state of the art includes various devices for serving and consuming beverages. In particular, an individual may desire to consume an alcoholic beverage, such as a liquor, with a non-alcoholic or low alcohol content beverage. A commonly accepted method of alcoholic beverage consumption is to mix and dilute a liquor with a non-alcoholic or low alcohol content beverage in a single drinking vessel. These mixed drinks are well known, and include martinis, manhattans, screwdrivers, gimlets, and old-fashions, to name only a few such mixed drinks. Another common method of alcoholic beverage consumption of liquors is the so-called "a shot and a chaser" technique. A vessel containing undiluted liquor is provided and a separate second vessel containing a non-alcoholic or low alcohol content beverage (the chaser) is also provided. The drinker first swallows the shot of liquor from the liquor vessel, and then drinks the "chaser" from the second vessel. This technology is believed to have significant limitations and shortcomings, including but not limited to that a significant time laps occurs between the consumption of the liquor and the consumption of the non-alcoholic or low alcohol content beverage chaser.

For this and other reasons, a need exists for the present invention. This invention provides a single vessel for the sequential consumption of a liquor beverage followed immediately by the consumption of a non-alcoholic or low alcohol content beverage chaser, which is believed to fulfill the need and to constitute an improvement over the background technology.

All United States patents and patent applications, and all other published documents mentioned anywhere in this application are incorporated by reference in their entirety. Some examples of multi-compartment vessels for which patents have been granted include the following.

Sawyer, in U.S. Pat. No. 149,887, describes a shaving mug with an integral vessel (B) on one side to hold a shaving brush.

In U.S. Pat. No. 258,777, Leonard discloses a similar shaving mug with an integral vessel containing an inwardly positioned spout used for holding the shaving soap.

Zodac, in U.S. Pat. No. 1,164,050, describes a two-compartment pail with a divider separating the pail into two equal compartments.

In U.S. Pat. No. 1,275,467, Poulalion discloses a deglutitory cup for helping an individual to swallow a pill or capsule. The cup contains an internal receptacle secured adjacent the rim of the cup. The receptacle is supported on one side by two parallel vertical ribs which secure the receptacle to the inner wall of the cup. A channel between the receptacle and the cup wall carries liquid as the cup is tilted toward the mouth of the individual. Liquid within the cup carries the pill or capsule into the individual's mouth for easy swallowing.

Judge et al., in U.S. Pat. No. 1,488,397, describe another double compartment pail with a suitable handle for carrying.

In U.S. Pat. No. 1,848,331, Esslinger discloses yet another two-compartment pail with an internal divider.

Turner, in U.S. Pat. No. 1,941,327, describes a drinking cup with an internal divider or partition which forms at one side the large dispensing or drinking receptacle, and at the other side the smaller auxiliary receptacle, both receptacles being within the wall of the cup. Overflow from the larger drinking receptacle is collected in the smaller auxiliary receptacle.

In U.S. Pat. No. 2,428,056, Wachsman discloses a drinking glass or cup with a baffle that inserts a portion of the depth of the glass or cup. The baffle prevents spillage from the container when sudden movement occurs, such as when traveling in a vehicle.

Walker, Jr., in U.S. Pat. No. 3,261,494, describes an individual communion service glass that includes a smaller, shallow compartment for holding the communion wafer for bread, and a larger, deeper compartment for holding the communion wine. The wall separating the two compartments is shown as generally vertical.

In U.S. Pat. No. 4,150,089, Linet discloses a multi-chamber test tube which includes a first and a second matched, separate, elongated tubular member. Means to connect the members together defines a test tube means having a dual mouth, and a stopper having a first leg and a second leg extending from the stopper body and receivable within the first and second elongate tubular members. A pathway is provided from a central cavity in the body of the stopper through each of the legs. A one-way valve is provided in each of the leg paths which is normally closed, yet yieldable to permit flow through the leg paths in response to an elevated pressure in the cavity relative to the interior of the test tube.

Jaarsma, in U.S. Pat. No. 4,277,000, describes a multi-compartment container that includes a molded body and a molded cap secured thereto. The body includes a confining wall forming a space, an internal dividing wall forming separate compartments within the space, and a base. The interface between the dividing wall and an inner side surface of the body defines a fluid seal between the compartments. The dividing wall forms an opening at an upper end of the body which communicates with one of the compartments. The cap is secured to the upper end of the body to form a seal there around. The cap includes a first port aligned with the opening in the dividing wall to form a passage therewith, and a second port communicating with the other compartment. A compressible endless seal ring is mounted in a groove in either the cap or the dividing wall to form a seal around the passage at the interface between the first port and the opening when the cap is installed onto the body portion.

In U.S. Pat. No. 4,410,085, Beneziat et al. disclose a tumbler that comprises a recipient in the form of a glass whose bottom is provided with an axial tube in which is screwed the open base of a sleeve containing a flask, the opening of the latter being hermetically applied against a seal. When this sleeve is unscrewed, the contents of the flask mix with those of the glass.

Holloway, in U.S. Pat. No. 4,428,490, discloses drinking vessels, such as cups, mugs, beakers, tumblers or glasses, whether of glass, plastics or other suitable material. The drinking vessels comprise an integral "straw" and base in the form of a hollow tube, which may be singly or multiply coiled and which is in liquid flow communication with the "glass proper," herein termed a reservoir. Liquid in the reservoir can be sucked in the manner of a drinking straw or in the normal way by drinking from the rim of the reservoir.

U.S. Pat. No. 4,955,503, by Propes discloses a souvenir drinking cup having a first drinking compartment and a second drinking compartment effectively isolated from each other by a partition and seal when a lid is fitted over the open top of the cup. Interfitting parts align the lid so that dispensing outlets are correctly positioned over the drinking compartments. Handles associated with each drinking compartment provide further positioned dispensing outlets for simultaneous drinking from the souvenir cup by two persons.

Ibrahim et al., in U.S. Pat. No. 5,223,245, describe a mouth rinse product that includes a multi-compartment bottle with liquids of different colors stored in the compartments. The combined stream of the liquids dispensed from the bottle combine to form a liquid mixture of yet another color. Two or three separate containers with separate outlets are shown.

In U.S. Pat. No. 5,398,827, Armstrong et al. disclose a multi-vessel beverage container including at least two elongated vessels or tubes which are connected in an adjacent relationship relative to each other. Each tube has an open top portion and a closed bottom portion such that each tube can hold a beverage therein. The tubes are connected such that the top portions of the tubes are disposed in generally coplanar relation relative to each other. The cross-sectional configuration of the tubes is specifically sized toward the top portions thereof to define a cumulative width between opposite sides of the tubes to facilitate simultaneous and direct pouring of the beverages from the tubes into a person's mouth where the beverages commingle with each other to provide a taste sensation different from that provided by either individual beverage.

Frazier, in U.S. Pat. No. 5,405,030, describes a drinking cup having a generally cylindrical rim portion above an at least semi-cylindrical base portion. A generally semi-cylindrical rear wall is disposed between a segment of the rim portion and the base portion, while an also semi-cylindrical front wall is disposed between the remaining segment of the rim portion and a level significantly above the base portion. A rear floor joins the lower end of the rear wall and the base portion, and an upper floor joins the front wall at the defined level. A vertical, generally central, divider defines, with the rear wall and the rear floor, a long rear compartment and also defines, with the front wall and the upper floor, a short front compartment. A handle is shaped to permit handling by either the right or left hand and may be formed during manufacture as a separate sub-assembly which includes an insert that is received to become a continuation of the front wall below the upper floor. The relative volumes of the front and rear compartments are selected so that upon draining the front compartment, the rear compartment retains a volume about half that originally poured into the drinking cup.

U.S. Pat. No. 5,553,725 by Clemons describes a "quarters" glass having two compartments, one for receiving a liquid and the other for receiving a quarter which is bounced off a surface. A slot may be formed in the second compartment to permit the quarter to exit the glass. A guide may be connected to the slot to guide the quarter to a predetermined area. The two compartments are arranged in an annular relationship.

Taggart, in U.S. Pat. No. 5,857,584, describes a drinking glass liner utilized to retain ice pieces within a drinking glass and permit a liquid entrapped within the ice pieces to drain away from the ice pieces. The drinking glass liner comprises a mesh sheet having a textured front side, interconnected links which define openings, and ridges extending outwardly from a back side. Protrusions, optionally, may extend outwardly from the front side to additionally retard movement of ice pieces. The ridges are provided to create a gap between an inner surface of the drinking glass and the back side to enable the liquid to freely flow away from the ice pieces.

In U.S. Pat. No. 5,878,908, Foley discloses a supplemental feeding cup for infants wherein the feeding cup comprises a main receptacle member having an internal channel formed in the front wall of the receptacle member. The internal channel is in open fluid communication with an auxiliary reservoir member that projects outwardly from the front wall of the receptacle member.

Wright et al., in U.S. Pat. No. 5,934,501, describe a beverage container for use with a drinking cup for dividing the cup into at least two individual beverage containing cells, each of which forms a discrete beverage container separate from the other. The beverage container comprises a semi-cylindrical, vertically tapered device, sized and shaped for mating insertion into a conventional tapered drinking cup. The beverage container includes a side wall, having a top rim forming an opening, and a bottom. The side wall includes a curved, vertically tapered first side wall portion and a generally planar, vertically tapered second side wall portion. An elongated flexible tab is connected on one end thereof along a curved portion of the beverage container rim and folds over the rim of the cup upon insertion. The tab includes markings for identifying the particular type, flavor, or brand of beverage contained within the beverage container portion of the drinking cup. The present invention thus allows a consumer to enjoy more than one flavor of beverage from a single cup, or, alternatively, allows a consumer to share a drink with a companion in a sanitary manner, while allowing the consumer and companion to each consume his or her beverage of choice.

U.S. Pat. No. 5,954,213 by Gerhart et al. discloses a dual bottle formed by two separable, interlocked chambers. The chambers preferably each contain different ingredients and have adjacent product exit apertures so that after leaving the chambers, the separate product streams can mix. Preferably, the chambers are identical, which simplifies manufacturing.

Wilson, in U.S. Patent Application Publication No. U.S. 2003/0052018 A1, describes a beverage cup having a detachable saliva reservoir so that a user may enjoy a beverage and smokeless tobacco products simultaneously. The cup has a saliva conduit running from its upper extremity down to a saliva reservoir which screws on the bottom. The upper portion of the conduit is formed into a mouthpiece which allows the user to easily deposit the saliva without the risk of it contaminating the contents of the cup. The beverage within the cup and the saliva reservoir are separated by an internal bulkhead. Cleaning is facilitated by the fact that the reservoir unscrews from the bottom. Both the cup and the reservoir are placed in a dishwasher or washed by hand.

In U.S. Design Pat. No. 373,707, Seaburg shows a cup with an externally attached container for holding two cookies. Kilpatrick, et al., in U.S. Design Pat. Nos. 409,442 and 416,443 show several multiple chamber drinking cups.

Applicant has devised a single vessel for the sequential consumption of a liquor beverage followed immediately by the consumption of a non-alcoholic or low alcohol content beverage chaser.

SUMMARY OF THE INVENTION

The invention is directed to a two-compartment drinking vessel for consuming separate liquids. The vessel includes an outer drinking vessel having a closed bottom section, a generally vertical sidewall section intersecting the outer vessel bottom section, the sidewall section with an upper rim there around, the outer vessel having an open top. Within the outer vessel is an inner, closed bottom, linear vessel with a sidewall section having an upper rim there around, the inner vessel having an open top. The linear interior vessel sidewall section extends essentially diagonally from a selected point on or adjacent the outer vessel upper rim, to a selected point at or adjacent the intersecting sidewall and bottom sections of the outer vessel. Liquids poured into the outer vessel and inner vessel are separately contained until the two-compartment vessel is tilted to elevate the outer vessel bottom relative to the selected point on the outer vessel upper rim adjacent the inner vessel sidewall section. The liquid contained by the inner vessel flows from the two-compartment vessel prior to the liquid contained in the outer vessel flowing therefrom.

DESCRIPTION OF THE EMBODIMENTS

Nomenclature

10 Two-Compartment Drinking Vessel
20 Outer Drinking Vessel
25 Bottom Section of Outer Vessel
30 Sidewall Section of Outer Vessel
35 Upper Rim of Outer Vessel
40 Open Top of Outer Vessel
50 Inner Drinking Vessel
55 Bottom Section of Inner Vessel
60 Sidewall Section of Inner Vessel
65 Upper Rim of Inner Vessel
70 Open Top of Inner Vessel
75 Supporting Wall Member Construction The present invention is directed to a concentric, two-compartment drinking vessel for consuming separate liquids. The vessel includes an outer drinking vessel having a closed bottom section, with a generally vertical sidewall section intersecting the outer vessel bottom section. The sidewall section has an upper rim there around, and the outer vessel has an open top. Within the outer vessel is an inner, closed bottom, linear vessel with a sidewall section having an upper rim there around. The inner vessel also has an open top. The linear interior vessel sidewall section extends essentially diagonally from adjacent a selected point on the outer vessel upper rim to a selected point adjacent the intersecting sidewall and bottom sections of the outer vessel. Liquids poured into the outer vessel and inner vessel are separately contained until the two-compartment vessel is tilted to elevate the outer vessel bottom relative to the selected point on the outer vessel upper rim adjacent the inner vessel sidewall section. The liquid contained by the inner vessel flows from the two-compartment vessel prior to the liquid contained in the outer vessel flowing therefrom.

Figure 1:
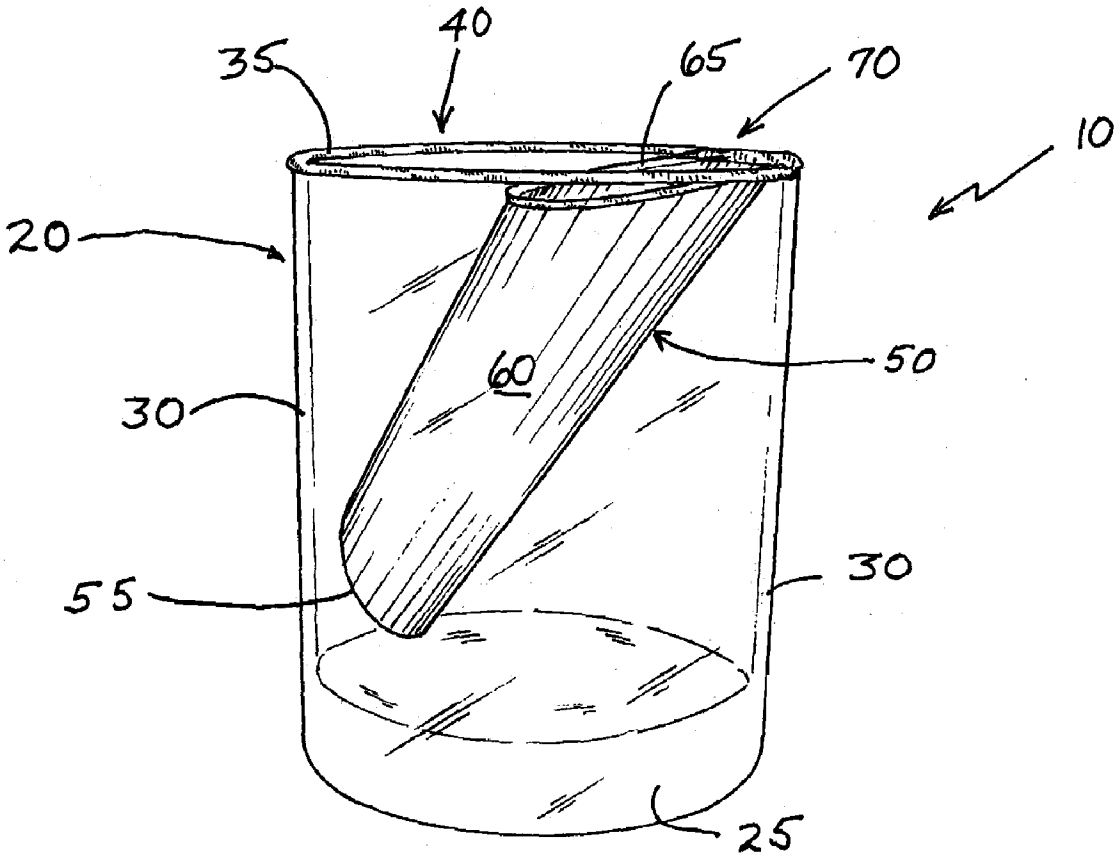
FIG. 1 is a perspective view of one embodiment of the concentric two-compartment drinking vessel of the present invention.
Figure 2:
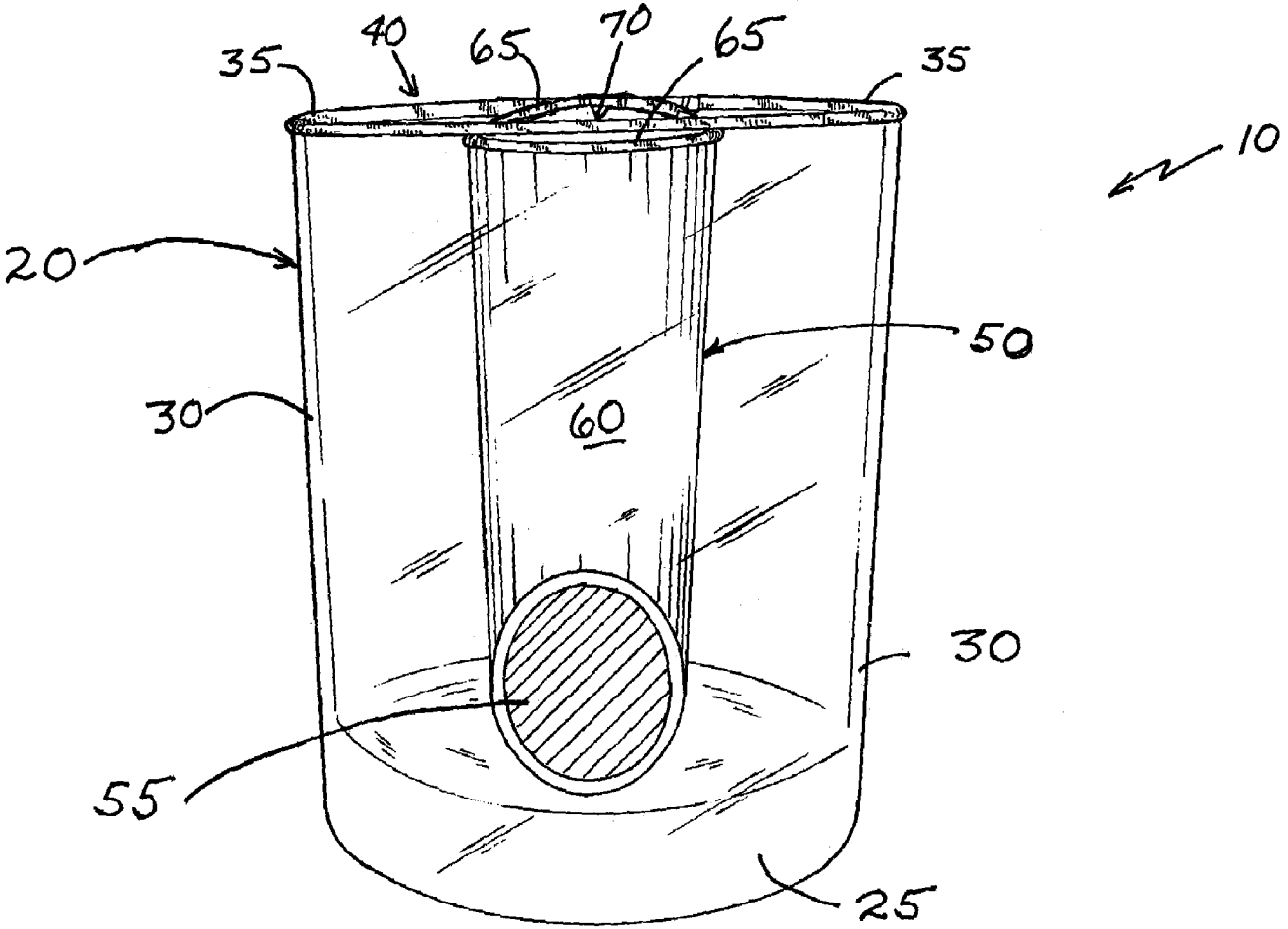
FIG. 2 is another perspective view of the FIG. 1 embodiment of the concentric two-compartment drinking vessel of the present invention.
Figure 3:
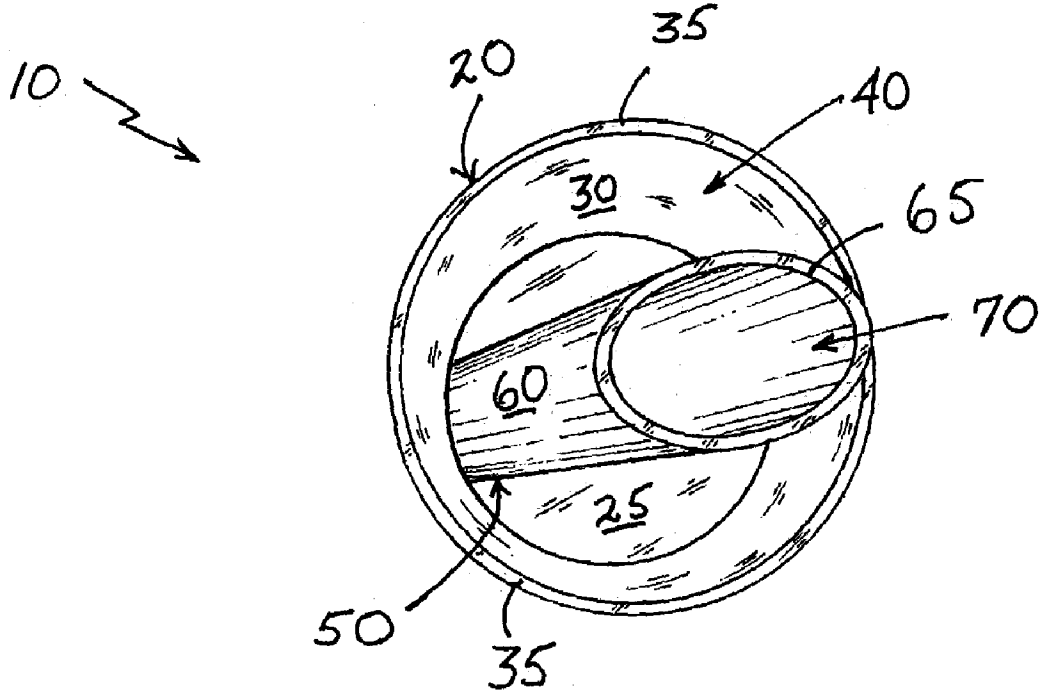
FIG. 3 is a top plan view of the FIG. 1 embodiment of the concentric two-compartment drinking vessel of the present invention.

Referring now to FIGS. 1–3, one embodiment of the concentric, two-compartment drinking vessel 10 for consuming separate liquids is shown. The vessel 10 includes an outer drinking vessel 20, having a closed bottom section 25, and a generally vertical sidewall section 30 intersecting the outer vessel bottom section 25. The sidewall section 25 includes an upper rim 35 there around, and the outer vessel has an open top 40. Within the outer vessel 20 is an inner, linear vessel 50 with a closed bottom section 55 and a sidewall section 60 having an upper rim 65 there around. The inner vessel 50 also has an open top 70. The linear interior vessel's sidewall section 60 extends essentially diagonally from adjacent a selected point on the outer vessel's upper rim 30 to a selected point adjacent the intersecting sidewall section 30 and bottom section 25 of the outer vessel 20. Liquids poured into the outer vessel 20 and the inner vessel 50 are separately contained until the two-compartment vessel 10 is tilted to elevate the outer vessel bottom 25 relative to the selected point on the outer vessel's upper rim 30 adjacent the inner vessel's sidewall section 60. The liquid contained by the inner vessel 50 flows from the two-compartment vessel 10 prior to the liquid contained in the outer vessel 20 flowing therefrom.

In the present embodiment of the invention shown in FIGS. 1–3, the upper rim 65 of the linear interior vessel sidewall section 60 contacts the selected point on the outer vessel upper rim 35 and extends essentially diagonally toward the intersection of the sidewall section 30 and bottom section 25 of the outer vessel 20. The contact between the vessel rims 35, 65 is best seen in FIG. 3. The outer vessel's upper rim 35 and the inner vessel's upper rim 65 are essentially coplanar, as illustrated in FIGS. 1—3. In this embodiment, the linear interior vessel 50 is conical with an internal diameter decreasing with increasing distance from the open top 70 thereof. Alternatively, the linear interior vessel 50 may be cylindrical with a constant internal diameter from the open top 70 to the closed bottom section 55. Preferably the two-compartment drinking vessel 10, including both the outer vessel 20 and the inner vessel 50, are fabricated from a transparent material, such as clear glass or a polymeric resin material. The transparency of both vessels 20, 50 allows the drinker to see the liquids contained within each compartment prior to consumption.

Figure 4:
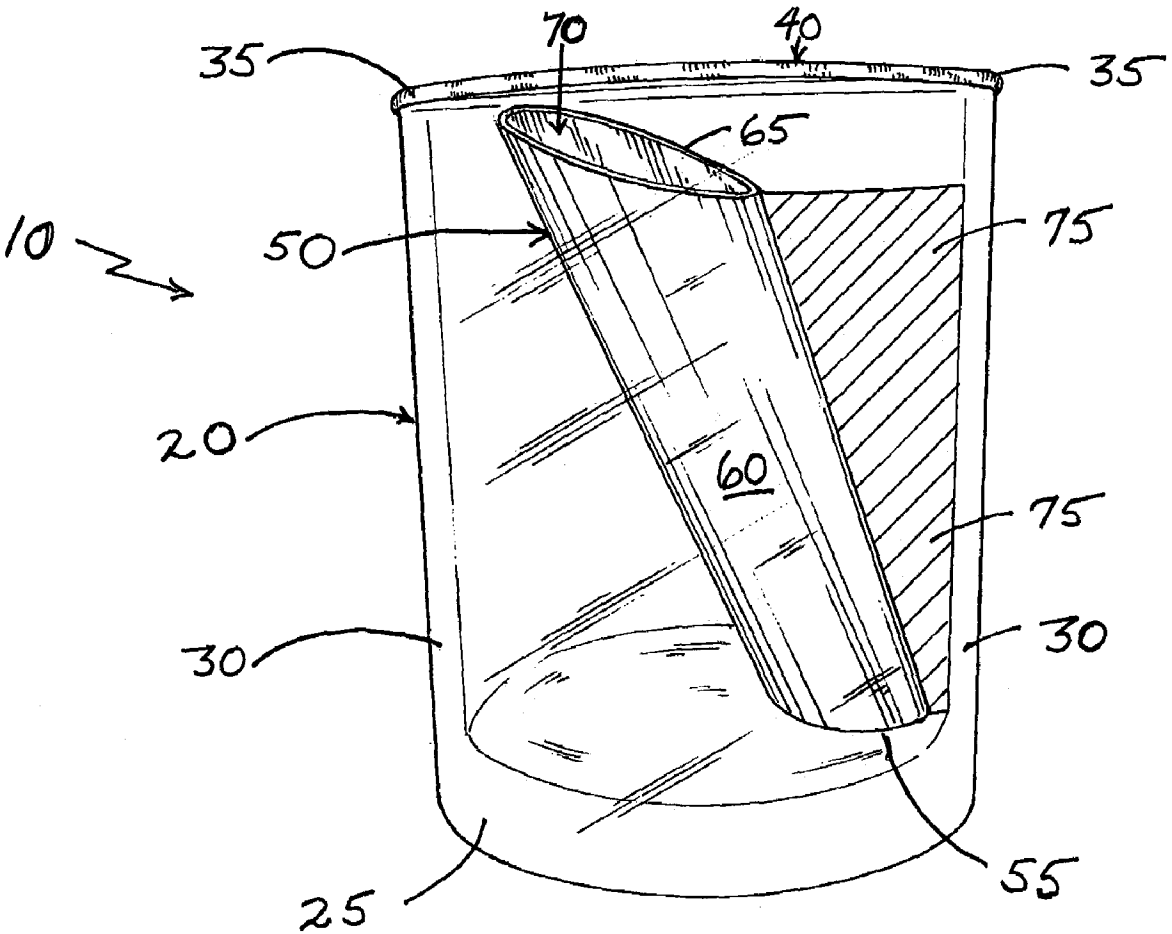
FIG. 4 is a perspective view of another embodiment of the concentric two-compartment drinking vessel of the present invention.
Figure 5:
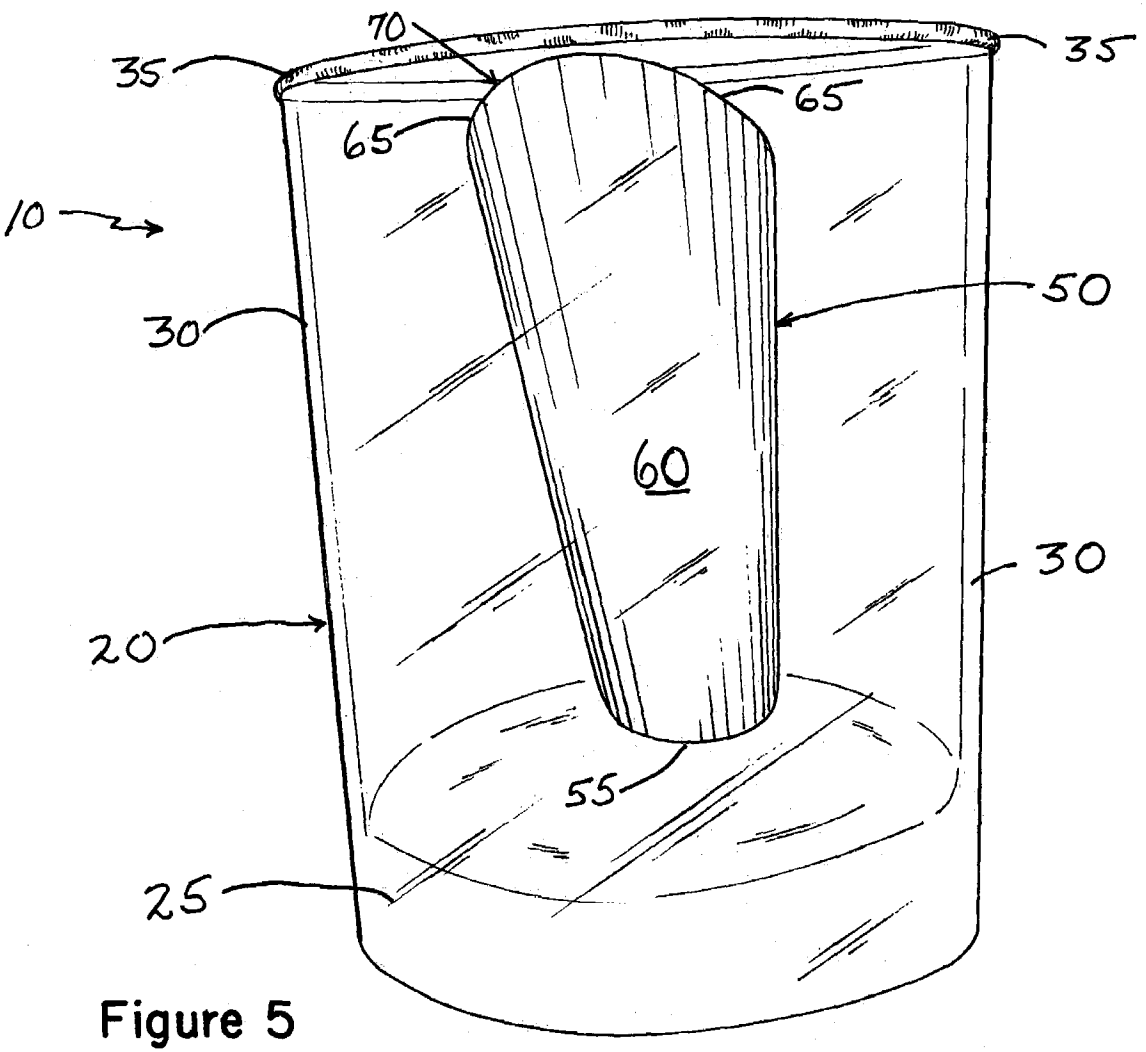
FIG. 5 is another perspective view of the FIG. 4 embodiment of the concentric two-compartment drinking vessel of the present invention.
Figure 6:
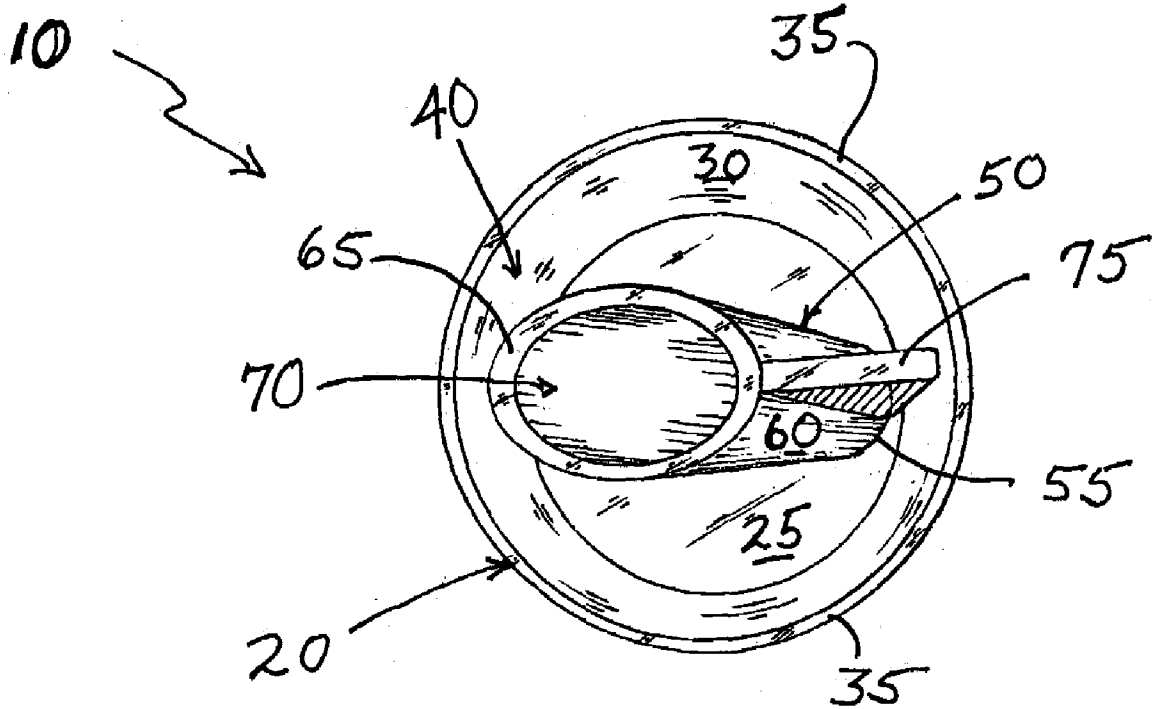
FIG. 6 is a top plan view of the FIG. 4 embodiment of the concentric two-compartment drinking vessel of the present invention.

Another embodiment of the present invention is shown in FIGS. 4–6. In this embodiment, the upper rim 65 of the linear, interior vessel's sidewall section 60 is slightly separated from the selected point on the outer vessel's upper rim 35 and extends essentially diagonally toward the intersection of the sidewall section 30 and bottom section 25 of the outer vessel 20. This embodiment of the invention includes a supporting wall member 75 between the inner vessel's sidewall section 60 and the outer vessel's sidewall section 30, as illustrated in FIGS. 4 and 6. The supporting wall member 75 provides support and attachment of the inner vessel 50 with the outer vessel 20, where the upper rim 65 of the inner vessel 50 does not contact the outer vessel's upper rim 35. In this embodiment of the invention, the sidewall upper rim 35 of the outer vessel 20 is planar and the sidewall upper rim 65 of the inner vessel 50 progressively descends below the plane of the outer vessel's sidewall rim 35 with increasing distance from the outer vessel's sidewall rim 35. This preferred embodiment provides space for the drinkers upper lip and nose, as the drinker raises the two-compartment drinking vessel 10 to consume the liquids contained separately therein. In the embodiment shown in FIGS. 4–6, the linear, interior vessel 50 is conical with an internal diameter decreasing with increasing distance from the open top 70 thereof. Alternatively, the linear interior vessel 50 may be cylindrical with a constant internal diameter from the open top 70 to the closed bottom section 55. Preferably the two-compartment drinking vessel 10, including both the outer vessel 20 and the inner vessel 50, are fabricated from a transparent material, such as clear glass or a polymeric resin material. The transparency of both vessels 20, 50 allows the drinker to see the liquids contained within each compartment prior to consumption.

The descriptions above and the accompanying materials should be interpreted in the illustrative and not the limited sense. While the invention has been disclosed in connection with the preferred embodiment or embodiments thereof, it will be understood by those skilled in the art that various changes in form and details may be made therein without departing from the spirit and scope of the invention.

I claim:

1. A two-compartment drinking vessel for consuming separate liquids comprising:

a outer drinking vessel having a closed bottom section, a generally vertical sidewall section intersecting the outer vessel bottom section, the sidewall section with an upper rim there around, the outer vessel having an open top; and an inner, closed bottom, linear vessel with a sidewall section having an upper rim there around, the inner, linear vessel having an open top, the sidewall upper rim of the outer vessel and the sidewall upper rim of the inner vessel being coplanar, the inner linear vessel sidewall section extending essentially diagonally from adjacent a selected point on the outer vessel upper rim to a selected point adjacent the intersecting sidewall and bottom sections of the outer vessel;

whereby liquids poured into the outer vessel and inner vessel are separately contained until the two-compartment vessel is tilted to elevate the vessel bottom relative to the selected point on the outer vessel upper rim adjacent the inner vessel sidewall section, the liquid contained by the inner vessel flowing therefrom prior to the liquid contained in the outer vessel flowing therefrom.

2. The two-compartment drinking vessel for consuming separate liquids of claim 1 wherein, the inner linear vessel sidewall section contacts the selected point on the outer vessel upper rim and extends essentially diagonally therefrom.

3. The two-compartment drinking vessel for consuming separate liquids of claim 1 wherein, the inner, linear vessel sidewall section is separated from the selected point on the outer vessel upper rim and extends essentially diagonally within the outer drinking vessel.

4. The two-compartment drinking vessel for consuming separate liquids of claim 3, further including a supporting wall between the inner vessel sidewall section and the outer vessel sidewall section.

5. The two-compartment drinking vessel for consuming separate liquids of claim 1 wherein, the inner linear vessel is cylindrical.

6. The two-compartment drinking vessel for consuming separate liquids of claim 1 wherein, the inner linear vessel is conical with an internal diameter decreasing with increasing distance from the open top thereof.

7. The two-compartment drinking vessel for consuming separate liquids of claim 1 wherein, the outer vessel and the inner vessel are fabricated from a transparent material.

8. The two-compartment drinking vessel for consuming separate liquids of claim 7 wherein, the outer vessel and the inner vessel are fabricated from glass.

9. The two-compartment drinking vessel for consuming separate liquids of claim 7 where in the outer vessel and the inner vessel are fabricated from a polymeric resin.

10. A two-compartment drinking vessel for consuming separate liquids comprising:

a outer drinking vessel having a closed bottom section, a generally vertical sidewall section intersecting the outer vessel bottom section, the sidewall section with a planar upper rim there around, the outer vessel having an open top; and an inner, closed bottom, linear vessel with a sidewall section having an upper rim there around, the inner, linear vessel having an open top, the inner, linear vessel sidewall section extending essentially diagonally from adjacent a selected point on the outer vessel upper rim to a selected point adjacent the intersecting sidewall and bottom sections of the outer vessel, the sidewall rim of the inner, linear vessel progressively descending below the outer vessel sidewall planar rim with increasing distance from the outer vessel sidewall rim whereby liquids poured into the outer vessel and inner vessel are separately contained until the two-compartment vessel is tilted to elevate the vessel bottom relative to the selected point on the outer vessel upper rim adjacent the inner vessel sidewall section, the liquid contained by the inner vessel flowing therefrom prior to the liquid contained in the outer vessel flowing therefrom.

11. The two-compartment drinking vessel for consuming separate liquids of claim 10 wherein, the inner, linear vessel sidewall section contacts the selected point on the outer vessel upper rim and extends essentially diagonally therefrom.

12. The two-compartment drinking vessel for consuming separate liquids of claim 10 wherein, the inner, linear vessel sidewall section is separated from the selected point on the outer vessel upper rim and extends essentially diagonally therefrom.

13. The two-compartment drinking vessel for consuming separate liquids of claim 12, further including a supporting wall between the inner vessel sidewall section and the outer vessel sidewall section.

14. The two-compartment drinking vessel for consuming separate liquids of claim 10 wherein, the inner linear vessel is cylindrical.

15. The two-compartment drinking vessel for consuming separate liquids of claim 10 wherein, the inner linear vessel is conical with an internal diameter decreasing with increasing distance from the open top thereof.

16. The two-compartment drinking vessel for consuming separate liquids of claim 10 wherein, the outer vessel and the inner vessel are fabricated from a transparent material.

17. The two-compartment drinking vessel for consuming separate liquids of claim 16 wherein, the outer vessel and the inner vessel are fabricated from glass.

18. The two-compartment drinking vessel for consuming separate liquids of claim 16 wherein, the outer vessel and the inner vessel are fabricated from a polymeric resin.

19. A two-compartment drinking vessel for consuming separate liquids comprising:

a outer drinking vessel having a closed bottom section, a generally vertical sidewall section intersecting the outer vessel bottom section, the sidewall section with a planar upper rim there around, the outer vessel having an open top; and an inner, closed bottom, linear vessel with a sidewall section having an upper rim there around, the inner, linear vessel having an open top, the inner linear vessel sidewall section extending essentially diagonally from adjacent a selected point on the outer vessel upper rim to a selected point adjacent the intersecting sidewall and bottom sections of the outer vessel, the sidewall rim of the inner, linear vessel progressively descending below the outer vessel sidewall planar rim with increasing distance from the outer vessel sidewall rim;

the outer vessel and the inner vessel fabricated from a transparent material;

whereby liquids poured into the outer vessel and inner vessel are separately contained until the two-compartment vessel is tilted to elevate the vessel bottom relative to the selected point on the outer vessel upper rim adjacent the inner vessel sidewall section, the liquid contained by the inner vessel flowing therefrom prior to the liquid contained in the outer vessel flowing therefrom.

* * * * *